United States Patent [19]

Ganz et al.

[11] 4,433,806

[45] Feb. 28, 1984

[54] CLOSURE INTERLOCK FOR CARTONS OF THE WRAP AROUND TYPE

[75] Inventors: Robert H. Ganz, Saddle River, N.J.; Guelfo A. Manizza, Blauvelt, N.Y.

[73] Assignee: Federal Paper Board Co., Inc., Montvale, N.J.

[21] Appl. No.: 370,387

[22] Filed: Apr. 21, 1982

[51] Int. Cl.[3] ..... B65D 5/10

[52] U.S. Cl. ..... 229/40; 206/139; 206/140; 229/38; 229/39 R; 229/45 R; 229/44 R

[58] Field of Search ..... 229/45 R, 38, 39 R, 229/44 R, 40, 37 R, 29 R; 53/48; 206/140, 139, 427–434

[56] References Cited

U.S. PATENT DOCUMENTS

| | | | |
|---|---|---|---|
| 2,990,099 | 6/1961 | Ryder | 229/39 R |
| 3,013,711 | 12/1961 | Kronson et al. | 229/45 |
| 3,098,583 | 7/1963 | Sherman et al. | 206/140 |
| 3,201,026 | 8/1965 | Travis et al. | 229/39 R |
| 3,220,155 | 11/1965 | Sherman | 53/48 |
| 3,270,914 | 9/1966 | Graser | 206/140 |
| 3,351,263 | 11/1967 | Wood | 229/40 |
| 3,384,291 | 5/1968 | Graser | 229/40 |
| 3,395,791 | 8/1968 | Graser | 229/40 |
| 3,478,951 | 11/1969 | Graser | 229/40 |
| 3,501,082 | 3/1970 | Lock | 229/39 R |
| 3,655,117 | 4/1972 | Weiss | 229/40 |
| 3,705,681 | 12/1972 | Rossi et al. | 229/40 |
| 4,200,220 | 4/1980 | Ganz | 229/40 |
| 4,337,888 | 7/1982 | Kudalkar | 229/39 R |

FOREIGN PATENT DOCUMENTS

| | | | |
|---|---|---|---|
| 651846 | 11/1962 | Canada | 229/45 |

*Primary Examiner*—William Price
*Assistant Examiner*—Bryon Gehman
*Attorney, Agent, or Firm*—Charles E. Brown

[57] ABSTRACT

This relates to a closure interlock for closure panels of cartons of the wrap around type. Each closure interlock includes a primary locking tab on an outer closure panel and a secondary locking tab and primary and secondary locking shoulders on an inner closure panel. The locking tabs are generally in alignment and the locking shoulders are spaced a very short distance transversely of the length of the closure interlock. This permits a very shallow angle of entry of the secondary locking tabs so that the closure interlocks may be aligned with and generally underlie items being packaged within the associated carton.

10 Claims, 13 Drawing Figures

CLOSURE INTERLOCK FOR CARTONS OF THE WRAP AROUND TYPE

This invention relates in general to new and useful improvements in cartons of the wrap around type, and more particularly to a novel closure interlock which is of a construction which permits a saving of material by providing primary and secondary locking tabs on different ones of closure panels.

A wrap around carton has a closure panel assembly defined by an inner closure panel and an outer closure panel and these panels are interlocked together by means of a closure interlock. In the past, the outer closure panel is provided with primary and secondary interlocking tabs which engage behind primary and secondary locking shoulders on the inner closure panel. This requires the locking shoulders and thus the locking tabs to be spaced transversely of the length of the closure interlock and thus a relatively great overlap of the inner and outer closure panels.

There has been developed a much improved closure interlock wherein the primary locking tab is carried by the outer closure panel and the secondary locking tab is carried by the inner closure panel and with the locking shoulders being only slightly offset from one another whereby there is a savings of material of the carton corresponding to the difference in the spacing of the locking shoulders of the improved locking closure over that of the prior art. However, in this recent development, the locking tabs are offset from one another with the result that the entrance angle of the secondary locking tab through aligned openings in the closure panels is rather steep and the closure interlock is generally restricted to the packaging of articles whereby the secondary locking tab may be aligned with a position between a group of wrapped articles, for example the spacing between four adjacent cans.

In accordance with this invention, the recently developed closure interlock is improved by aligning the secondary locking tab with the primary locking tab and permitting the primary locking tab to overlie the secondary locking shoulder whereby the entrance angle of the secondary locking tab through aligned openings in the overlapped closure panels is relatively shallow and the secondary locking tab may enter into the carton beneath a packaged article.

The closure interlock in accordance with this invention may include plural primary locking tabs carried by a terminal edge flap of the outer closure panel cooperating with individual and separately formed secondary locking tabs carried by the inner closure panel, or with plural secondary locking tabs carried by a single secondary flap.

With the above and other objects in view that will hereinafter appear, the nature of the invention will be more clearly understood by reference to the following detailed description, the appended claims, and the several views illustrated in the accompanying drawings.

Figure 2:
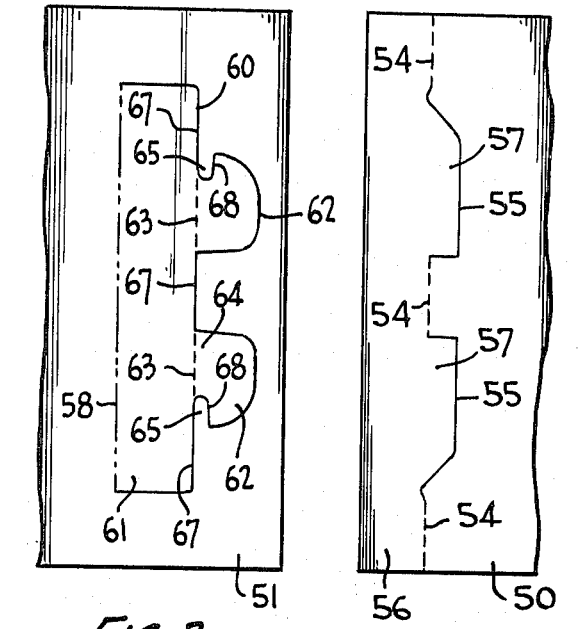
FIG. 2 is an enlarged bottom plan view of closure panels incorporating a closure interlock in accordance with this invention.
Figure 7:
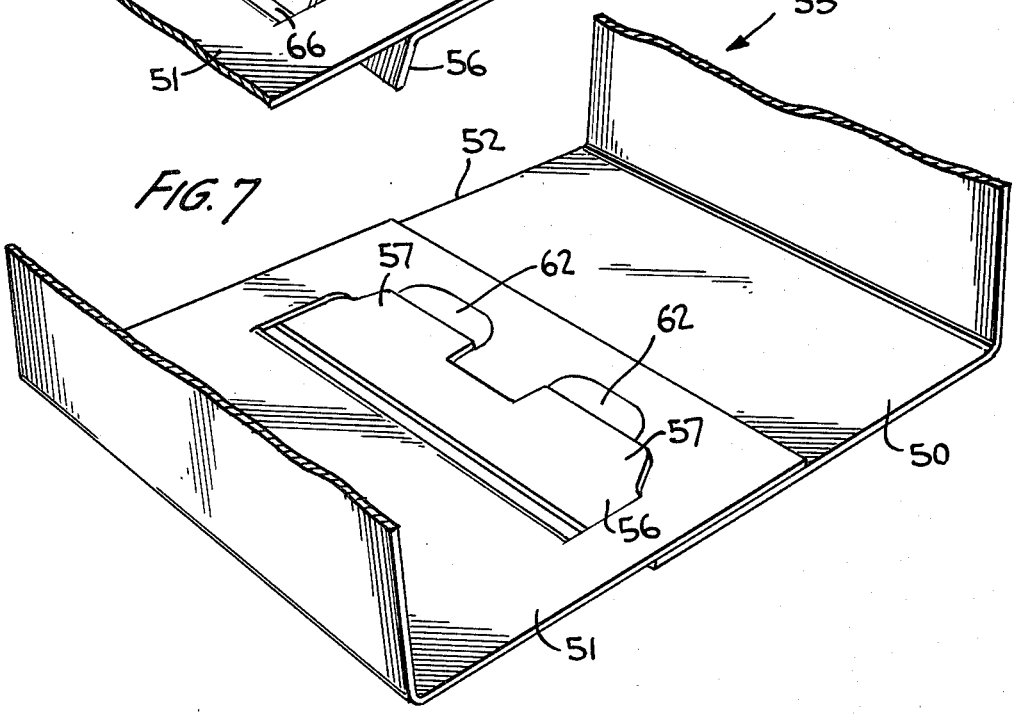
FIG. 7 is a fragmentary perspective view of the closure panel assembly of the container and the details of the closure interlock.
Figure 8:
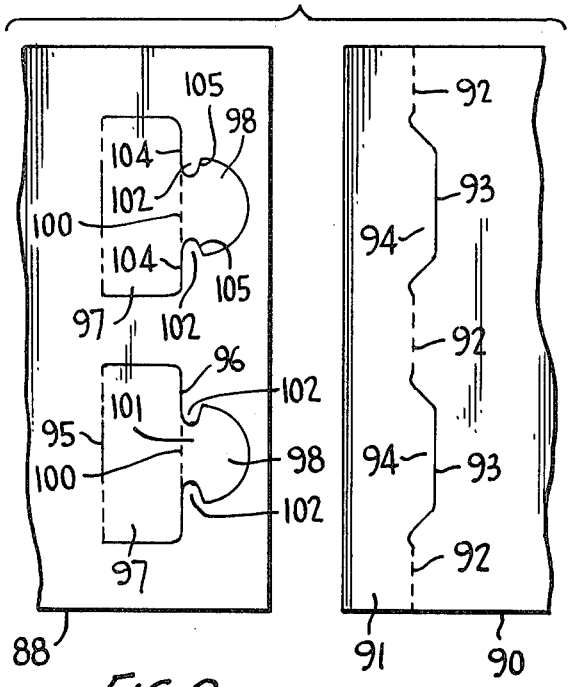
FIG. 8 is a bottom plan view similar to FIG. 2 and shows a modified form of closure interlocks.

Referring now to the drawings in detail, reference is first made to FIG. 2 wherein there is illustrated an outer closure panel 50 and an inner closure panel 51 of a closure panel assembly 52 of a carton 53 of which the lower portion only is shown in FIG. 7.

The closure panel 50 is provided with a combination of fold or hinge lines 54 and cut lines 55 to define along the free edge thereof a terminal flap portion 56 which carries a pair of primary locking tabs 57 which are spaced along the general length of the closure panel 50.

The inner closure panel 51 is provided with a fold or hinge line 58 generally parallel to its free edge and which in association with a cut line 60 defines a secondary flap 61 carrying a pair of secondary locking tabs 62. Each secondary locking tab 62 is hingedly connected to the secondary flap 61 along a hinge or fold line 63.

Further, each locking tab 62 is provided with a reduced width neck portion 64 generally defined by an elongated finger 65 which projects generally into the secondary locking tab 62. The fingers 65 are arranged in generally opposed relation.

Figure 4:
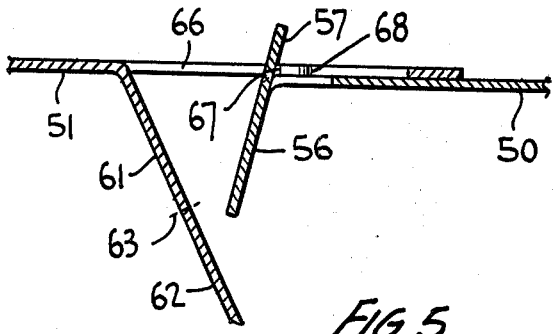
FIG. 4 is an enlarged fragmentary vertical sectional view taken generally along the line 4—4 of FIG. 3 and shows further the details of the partially formed closure interlock.

When the secondary flap 61 and the secondary locking tab 62 are struck downwardly out of the plane of the inner closure panel 51, as is shown in FIG. 4, a relatively large opening 66 is formed in the inner closure panel 51 and there is defined on the inner closure panel 51 primary locking shoulders 67 and on the fingers 65 secondary locking shoulders 68.

Figure 5:
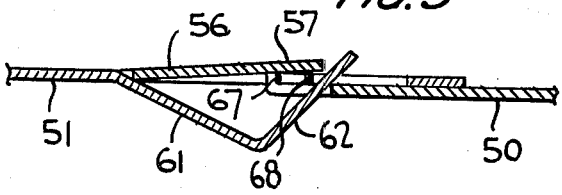
FIG. 5 is a fragmentary sectional view similar to FIG. 4 and shows the primary locking tabs in place and the secondary locking tabs in their initial phase of passing through the closure panels.

With the secondary locking tab 62 and the secondary flap 61 struck downwardly out of the inner closure panel 51 and the terminal flap portion 56 folded to a downward position, an initial interlock may be made by inserting the primary closure tab 57 through the opening 66 and behind the shoulders 67, as is shown in FIG. 4. The terminal flap portion 56 may then be folded upwardly against the underside of the inner closure panel 51, as shown in FIG. 5, afterwhich the secondary locking tabs 62 may be hinged relative to the secondary flap 61 and advanced through the outer closure panel 50 to the right of the primary locking tabs 57 and through those portions of the inner closure panel 51 from which the secondary locking tabs have been struck, as is shown in FIG. 5. It will be seen that the secondary locking shoulders 68 underlie the primary locking tabs 57 and are so positioned whereby the angle of entry of the secondary locking tabs 62 is relatively shallow so that the secondary locking tabs 62 may enter beneath overlying articles which are being formed into a package within the carton 53.

Figure 6:
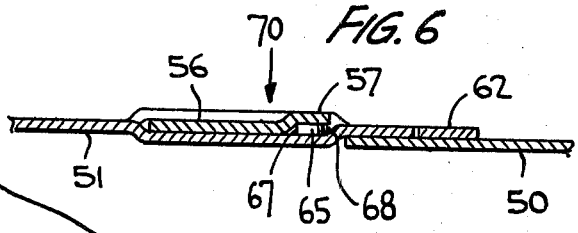
FIG. 6 is another fragmentary sectional view similar to FIG. 4 and shows the completed closure interlock.
Figure 3:
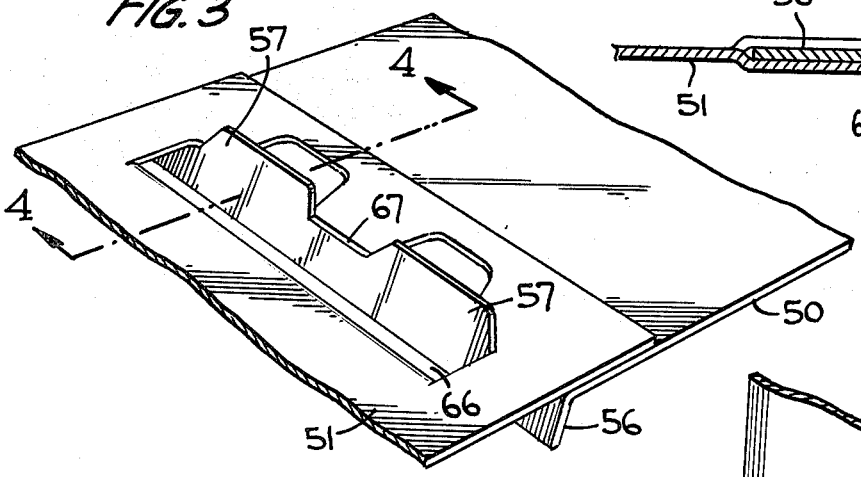
FIG. 3 is a perspective view showing the closure panels brought together and the primary locking tabs initially engaged with primary locking shoulders on the inner closure panel.

The movement of the secondary locking tab 62 into the interior of the carton continues until the secondary locking tabs 62 are totally within the carton and overlying the inner closure panel 51, as is shown in FIG. 6. The closure interlock, generally identified by the numeral 70 is now complete.

Figure 1:
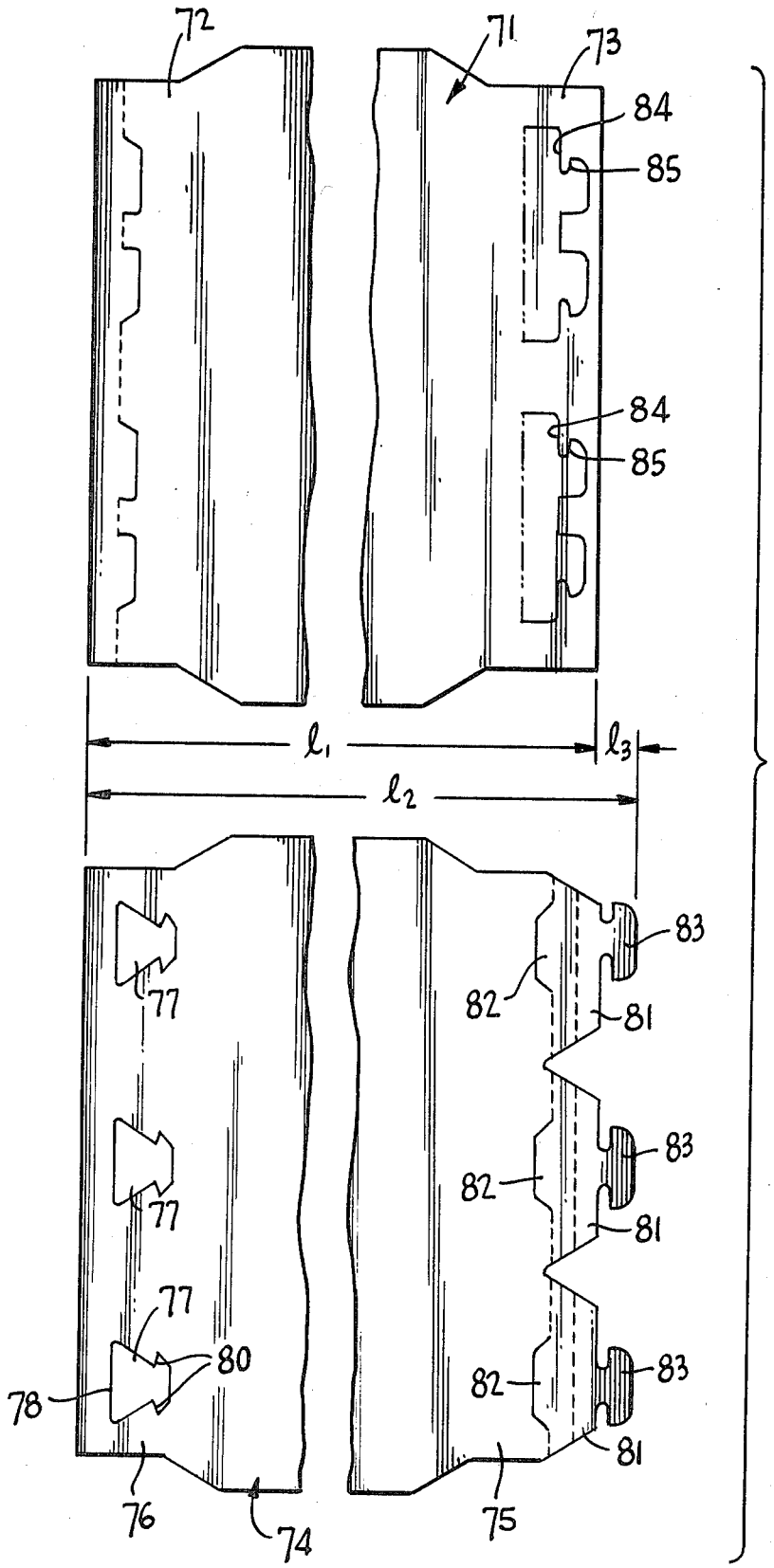
FIG. 1 is a plan view comparing the overall lengths of a conventional carton blank having primary and secondary locking tabs carried by the outer closure panel and a carton wherein the closure interlock is one wherein the primary locking tabs are carried by the outer closure panel and the secondary locking tabs are carried by the inner closure panel.

Referring now to FIG. 1, it will be seen that there is illustrated a carton of the wrap around type which is generally identified by the numeral 71 and includes an outer closure panel 72 and an inner closure panel 73 generally corresponding to the closure panels 50 and 51, respectively. The carton 71 is provided with two closure interlocks generally corresponding to the closure interlock 70 for interlocking the closure panels 72 and 73 in the manner illustrated in FIG. 7.

In FIG. 1 there is also illustrated a conventional type of wrap around carton generally identified by the numeral 74. It is to be understood that the carton 74 will be of the same overall size for forming a package of one or more items in the same manner as in the case of the carton 71. However, the carton 74 is provided with an outer closure panel 75 and an inner closure 76 with an entirely different type of closure interlock. The closure interlock of the carton 74 includes cutouts 77 in the inner closure panel 76 which define primary locking shoulders 78 spaced from secondary locking shoulders 80. In a like manner, the outer closure panel 75 is provided with one or more terminal flap portions 81 which carry primary locking tabs 82 and secondary locking tabs 83 for engagement with the locking shoulders 78 and 80, respectively.

It will be seen that the locking shoulders 78 and 80 are spaced a considerable distance transversely of the length of the closure panels 75, 76 whereas in accordance with the specific illustrations of FIGS. 2–7, the inner closure panel 73 of the carton 71 is provided with primary locking shoulders 84 and secondary locking shoulders 85 which are spaced closely together transversely of the length of the closure panels 72, 73. As a result, the overall length of the blank of the carton 71 is a length $l_1$ which is lesser than the length of the blank for the carton 74, $l_2$ by a distance $l_3$. The distance $l_3$ is basically equal to the spacing between a locking shoulder 78 and a locking shoulder 80 less the spacing between a locking shoulder 84 and a locking shoulder 85. This distance will be on the order of one half inch to three quarters inch and depending on the overall length of the carton blank may constitute a saving of carton stock equal to six percent or greater.

Figure 13:
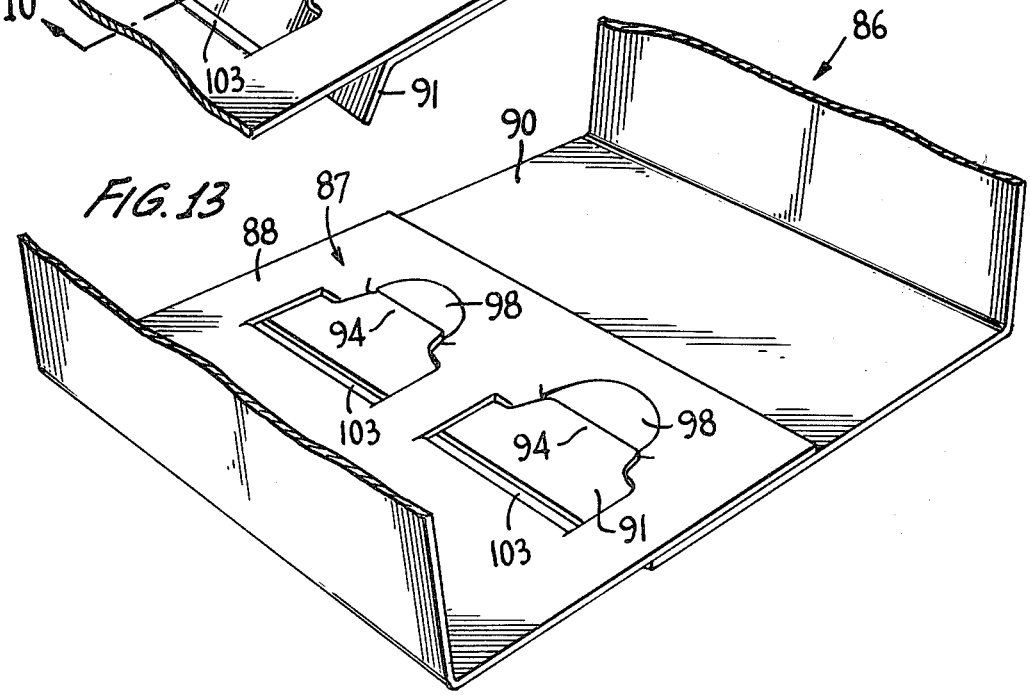
FIG. 13 is a fragmentary perspective view of the lower portion of a carton and shows the details of the closure panel assembly and the closure interlock.

Referring now to FIG. 13, it will be seen that there is illustrated a modified carton 86 having a closure panel assembly defined by a slightly modified form of closure interlock 87. The closure panel assembly includes an inner closure panel 88 and an outer closure panel 90.

The outer closure panel 90 has formed along the free edge thereof a terminal flap portion 91 which is defined by a combination of hinge lines 92 and cut lines 93 with the cut lines 93 defining along the terminal flap portion 91 primary locking tabs 94.

The inner closure panel 88 has in alignment with each of the primary closure tabs 94 a fold line 95 and a cooperating cut line 96 which define a secondary flap 97 carrying a secondary locking tab 98 with the secondary locking tab 98 being hingedly connected to the secondary flap 97 along a hinge line 100. It will be seen from FIG. 9 that the length of each primary closure tab 94 along the closure interlock is generally no greater than the length of each secondary flap 97 along the closure interlock.

Each of the secondary locking tabs 98 is provided with a narrow neck 101 defined by a pair of opposed fingers 102 generally projecting into the secondary locking tab 98.

When each secondary locking tab 98 and its associated flap 97 is struck downwardly out of the inner closure panel 88, there is formed in the closure panel 88 a relatively large opening 103. This opening provides on opposite sides of the initial position of each secondary locking tab 98 a primary locking shoulder 104. Also, the outline of the narrow neck 101 is such that part thereof along each finger 102 defines a secondary locking shoulder 105.

Figure 10:
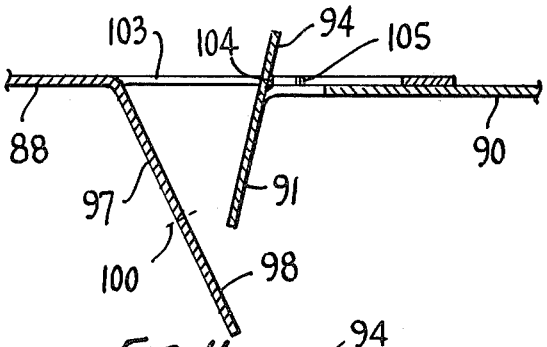
FIG. 10 is an enlarged fragmentary vertical sectional view taken generally along the line 10—10 of FIG. 9 and shows further the details of the initial engagement of parts of the closure interlock.
Figure 11:
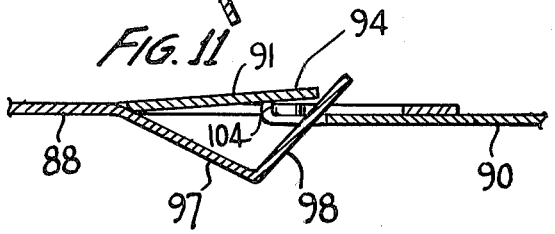
FIG. 11 is a vertical sectional view similar to FIG. 10 and shows the primary locking tabs fully in place and the secondary locking tabs in an initial position moving through the closure panels.
Figure 9:
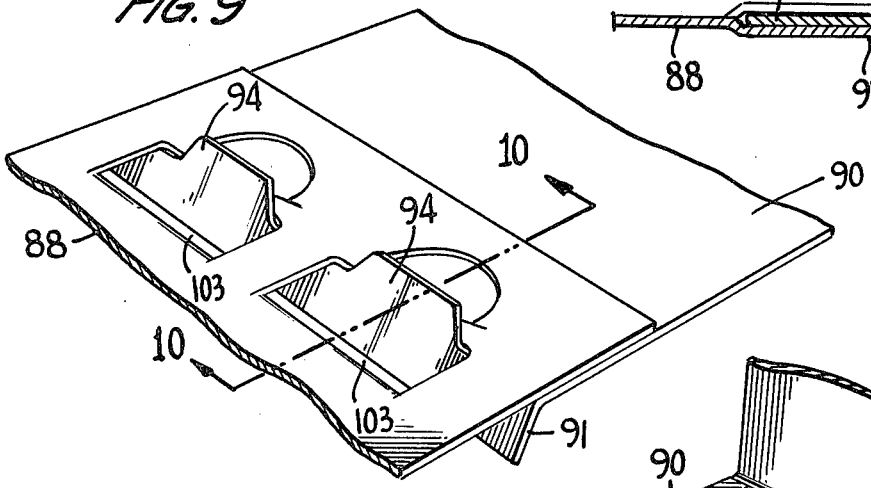
FIG. 9 is a fragmentary perspective view similar to FIG. 3 and shows the initial engagement of the primary locking tabs with the inner closure panel.

In forming the closure panel assembly of FIG. 13, the closure panels 88 and 90 are brought together with the closure panel 90 underlying the closure panel 88, as is generally shown in FIGS. 9 and 10. The primary closure tabs 94 are then passed through the openings 103 and engage behind the primary locking shoulders 104. Then the terminal flap portion 91 is swung up to a position generally underlying the adjacent portion of the closure panel 88, as is shown in FIG. 11. Next, each secondary locking tab 98 is hinged relative to its associated secondary flap 97 and is inserted through aligned opening portions in the closure panels 88, 90, as is shown in FIG. 11. It will be seen that the angle of entry of the secondary locking tabs 98 is relatively shallow as in the case of the secondary locking tabs 62 of the embodiment of the invention illustrated in FIGS. 2–7.

Figure 12:
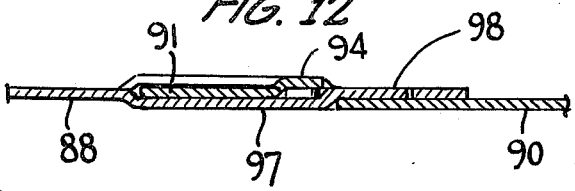
FIG. 12 is another sectional view similar to FIG. 10 and shows the completed closure interlock.

The secondary locking tabs 98 are continued to be moved into the container until they assume the positions illustrated in FIG. 12 overlying the adjacent portion of the inner closure panel 88 to complete closure interlock 87.

It is to be understood that because of the shallow angle of entry of the secondary locking tabs into the interior of the carton 86, the secondary locking tabs 98 may underlie articles which are being formed into a package by the carton 86.

Although preferred embodiments of the closure interlocks have been specifically illustrated and described herein, it is to be understood that minor variations may be made in the closure interlocks without departing from the spirit and scope of the invention as defined by the appended claims.

We claim:

1. A closure interlock for a closure panel assembly of a carton of the wrap around type, said closure interlock comprising an inner closure panel and an outer closure panel each having a free edge, said inner closure panel having struck therefrom a secondary locking tab carried by a secondary flap with said secondary locking tab being disposed between said free edge of said inner closure panel and said secondary flap, said secondary locking tab facing said free edge of said inner closure panel, the displacement of said secondary locking tab and said secondary flap from said inner closure panel defining an opening in said inner closure panel having as a boundary thereof a primary locking shoulder, and said outer closure panel having a terminal edge flap portion in part defined by a fold line and in part by cut line means, said cut line means defining a primary locking tab carried by said terminal edge flap portion and facing away from said outer closure panel free edge for locking behind said primary locking shoulder, said secondary locking tab being connected to said secondary flap by a narrow neck portion, said narrow neck portion having an outline of which a part defines at least one secondary shoulder on said inner closure panel separate from said secondary locking tab and facing away from said primary locking shoulder, and said secondary locking tab being aligned with said primary locking tab transversely of the length of said closure interlock.

2. A closure interlock according to claim 1 wherein said secondary locking tab engages behind said secondary locking shoulder and is positioned in that portion of said opening in said inner closure panel from which said secondary locking tab is struck.

3. A closure interlock according to claim 2 wherein said secondary locking tab extends through said outer closure panel immediately adjacent said primary locking tab.

4. A closure interlock according to claim 2 wherein said secondary locking tab extends through said outer closure panel immediately adjacent said primary locking tab and beneath a free edge portion of said primary locking tab.

5. A closure interlock according to claim 2 wherein said secondary locking shoulder underlies said primary locking tab.

6. A closure interlock according to claim 2 wherein said secondary locking shoulder underlies said primary locking tab a distance wherein said secondary locking tab may enter through said closure panels at a shallow angle for movement beneath an article being packaged in the carton.

7. A closure interlock according to claim 2 wherein said primary locking tab is a length along said closure interlock generally no greater than the length of said secondary flap along said closure interlock.

8. A closure interlock according to claim 1 wherein said terminal edge flap carries two of said primary locking tabs spaced along the length of said closure interlock, and there are two separate ones of said secondary locking tab and flap.

9. A closure interlock according to claim 1 wherein said terminal edge flap carries two of said primary locking tabs spaced along the length of said closure interlock, and there are two separate secondary locking tabs carried by a single secondary flap.

10. A closure interlock according to claim 9 wherein said narrow neck portion of each of said two secondary locking tabs is defined by a single finger projecting generally into said secondary locking tab with said fingers being in opposed relation.

* * * * *